US005968702A

United States Patent [19]

Ezenyilimba et al.

[11] Patent Number: 5,968,702

[45] Date of Patent: Oct. 19, 1999

[54] TONER PARTICLES OF CONTROLLED SHAPE AND METHOD OF PREPARATION

[75] Inventors: Matthew C. Ezenyilimba, Walworth; Mark A. Sweeney, Webster, both of N.Y.

[73] Assignee: Eastman Kodak Company, Rochester, N.Y.

[21] Appl. No.: 08/977,263

[22] Filed: Nov. 24, 1997

[51] Int. Cl.[6] ..... G03G 9/087

[52] U.S. Cl. ..... 430/111; 430/137

[58] Field of Search ..... 430/106, 110, 430/111, 137

[56] References Cited

U.S. PATENT DOCUMENTS

| | | | |
|---|---|---|---|
| 3,893,935 | 7/1975 | Jadwin et al. | 252/62.1 |
| 4,079,014 | 3/1978 | Burness et al. | 252/62.1 |
| 4,323,634 | 4/1982 | Jadwin | 430/110 |
| 4,833,060 | 5/1989 | Nair et al. | 430/137 |
| 4,965,131 | 10/1990 | Nair et al. | 428/407 |
| 5,108,863 | 4/1992 | Hsieh et al. | 430/109 |
| 5,283,151 | 2/1994 | Santilli | 430/137 |
| 5,298,355 | 3/1994 | Tyagi et al. | 430/110 |
| 5,298,356 | 3/1994 | Tyagi et al. | 430/110 |
| 5,399,454 | 3/1995 | Imai et al. | 430/109 |
| 5,510,219 | 4/1996 | Agata et al. | 430/106 |
| 5,629,367 | 5/1997 | Lofftus et al. | 524/88 |

FOREIGN PATENT DOCUMENTS

| | | |
|---|---|---|
| 1420839 | 1/1976 | United Kingdom . |

OTHER PUBLICATIONS

P. Chenebault and A. Schurenkamper, The Measurement of Small Surface Areas by the B.E.T. Adsorption Method, The Journal of Physical Chemistry, vol. 69, No. 7, Jul. 1965.

*Primary Examiner*—John Goodrow
*Attorney, Agent, or Firm*—Doreen M. Wells

[57] ABSTRACT

A method is described for the preparation of electrophotographic toner particles which includes the use of SOLSPERSE®. The method involves dissolving in ethyl acetate a hyperdispersant selected from SOLSPERSE® 24000 and SOLSPERSE® 20000, thereby forming a solution; mixing the solution with a polymer material to form an organic phase; dispersing the organic phase in an aqueous phase containing a particulate stabilizer and homogenizing the resultant dispersion; evaporating the solvent; and washing and drying the resultant product.

24 Claims, No Drawings

TONER PARTICLES OF CONTROLLED SHAPE AND METHOD OF PREPARATION

FIELD OF THE INVENTION

This invention relates to a method for the preparation of polymeric powders suitable for use as electrostatographic toner, and more particularly, to a method for preparation of toner particles of controlled shape in which SOLSPERSE® 24000 or 20000 is employed for controlling morphology of the particles.

BACKGROUND OF THE INVENTION

Electrostatic toner polymer particles are commonly prepared by a process frequently referred to as "limited coalescence". In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation. The resultant particles are then isolated, washed and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been describe in numerous patents pertaining to the preparation of electrostatic toner particles because such techniques typically result in the formation of toner particles having a substantially uniform size distribution. Representative limited coalescence process employed in toner preparation are described in Nair et al. U.S. Pat. Nos. 4,833,060 and 4,965,131.

U.S. Pat. No. 5,283,151 to Santilli is representative of the prior art in this field and describes the use of carnauba wax to achieve similar toner morphology. The '151 method comprises the steps of dissolving carnauba wax in ethyl acetate heated to a temperature of at least 75° C. and cooling the solution, so resulting in the precipitation of the wax in the form of very fine needles a few microns in length; recovering the wax needles and mixing therewith a polymer material, a solvent and optionally, a pigment and a charge control agent to form an organic phase; dispersing the organic phase in an aqueous phase comprising a particulate stabilizer; homogenizing the mixture; evaporating the solvent; and washing and drying the resultant product.

However, this technique requires the use of elevated temperature (at least 75° C.) to dissolve the wax in the solvent and then cooling the solution to precipitate the wax. The wax does not stay in solution of ethyl acetate at ambient temperature (less than 50° C.) which makes it very difficult to scale up production when using this methodology.

The shape of the toner particles has a bearing upon the electrostatic toner transfer and cleaning properties. Thus, for example, the transfer and cleaning efficiency of toner particles have been found to improve as the sphericity of the particles are reduced. Thus far, workers in the art have long sought to modify the shape of the evaporative limited coalescence type toners independently of pigment, binder, or charge agent choice in order to enhance the cleaning and transfer properties of the toner.

No prior art was found which suggested using SOLSPERSE® 24000 or 20000 dispersant in the manner of the present invention. The following documents disclose various toner preparations in which the use of a SOLSPERSE® 24000 dispersant is either claimed or disclosed: U.S. Pat. No. 5,108,863 to Hsieh et al.; U.S. Pat. No. 5,629,367 to Lofftus et al.; U.S. Pat. No. 5,399,454 to Imai et al.; U.S. Pat. No. 5,510,219 to Agata et al. and U.S. Pat. Nos. 5,298,355 and 5,298,356 to Tyagi et al.

U.S. Pat. No. 5,629,367 to Lofftus et al. describes a means to produce a dry pigment concentrate from a wet milled pigment utilizing SOLSPERSE® 24000, and subsequently, making electrophotographic toners by the conventional process of extrusion and classification of the toner. Limitations to the above conventional methodology include difficulty in attaining desired small particle size as well as narrow particle size distribution through a grinding process. Also, Lofftus teaches morphology and narrow particle size distribution of the dispersed pigment rather than controlled shape (sphericity) of the toner particles.

SUMMARY OF THE INVENTION

In accordance with the present invention, the prior art limitations are effectively obviated by a novel process in which a limited amount of SOLSPERSE® 24000 or 20000 is introduced into the organic phase of the limited coalescence process. The use of a limited amount of SOLSPERSE® 24000 or 20000, which is highly surface active in nature, results in the formation of non-spherical toner particles upon the removal of the solvent. The toner morphology is controlled independently of the toner composition (resin, binder matrix, pigment, charge control agent, etc.). The degree of nonsphericity is directly related to the SOLSPERSE® concentration.

Thus, viewed from one aspect, the present invention is directed to a method for the preparation of electrostatographic toner comprising the steps of: a) dissolving in ethyl acetate a hyperdispersant selected from SOLSPERSE® 24000 and SOLSPERSE® 20000, thereby forming a solution; b) mixing the solution with a polymer material to form an organic phase; c) dispersing the organic phase in an aqueous phase comprising a particulate stabilizer and homogenizing the resultant dispersion; d) evaporating the solvent; and e) washing and drying the resultant product.

Viewed from another aspect, the present invention is directed to a method for preparing electrostatographic toner by dispersing an organic phase in an aqueous phase to yield a layer of particulate stabilizer on the surface of a polymer, the improvement which comprises adding SOLSPERSE® in a solvent to a polymer material, a pigment and optionally a charge control agent to form an organic phase for dispersing in the aqueous phase.

These and other features and advantages of the present invention will be better understood taken in conjunction with the following detailed description and claims.

DETAILED DESCRIPTION OF THE INVENTION

In accordance with the present invention, a pigment dispersion is prepared by conventional techniques as, for example, by media milling, melt dispersion and the like. Next, the SOLSPERSE® 24000 or 20000 is dissolved in a solvent at low temperature (25° C. to 40° C.) and added to the pigment dispersion, polymer material, a solvent and optionally a charge control agent to form an organic phase in which the pigment concentration ranges from about 4% to 20%, by weight, based upon the total weight of solids. The pigment to SOLSPERSE® 24000 or 20000 ratio ranges from about 1:0.5 to 1:0.06. The charge control agent is employed in an amount ranging from 0 to 10 parts per hundred, based on the total weight of solids, with a preferred range from 0.2 to 3.0 parts per hundred. This mixture is permitted to stir overnight and then dispersed in an aqueous phase comprising a particulate stabilizer and optionally a promoter.

The solvents chosen for use in the SOLSPERSE® dissolution and organic phase steps may be selected from among any of the well known solvents capable of dissolving polymers of the type employed herein. Typical of the solvents chosen for this purpose are chloromethane, dichloromethane, ethyl acetate, vinyl chloride, methylethylketone and the like. Ethyl acetate has been found to be a particularly useful solvent for dissolution of SOLSPERSE® 24000 or 20000 in accordance with the invention.

The particulate stabilizer selected for use herein may be selected from among highly cross-linked polymeric latex materials of the type described in U.S. Pat. No. 4,965,131 to Nair et al., or $SiO_2$. Silicon dioxide is preferred. It is generally used in an amount ranging from 1 to 15 parts based on 100 parts of the total solids employed. The size and concentration of these stabilizers control and predetermine the size of the final toner particles. In other words, the smaller the size and/or the higher the concentration of such particles, the smaller the size of the final toner particles.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. Typical of such promoters are sulfonated polystyrenes, alginates, carboxy methyl cellulose, tetramethyl ammonium hydroxide or chloride, diethylaminoethylmethacrylate, water soluble complex resinous amine condensation products of ethylene oxide, urea and formaldehyde and polyethyleneimine. Also effective for this purpose are gelatin, casein, albumin, gluten and the like or nonionic materials such as methoxycellulose. The promoter is generally used in an amount from about 0.2 to about 0.6 parts per 100 parts of aqueous solution.

Various additives generally present in electrostatographic toner may be added to the polymer prior to dissolution in the solvent or in the dissolution step itself, such as charge control agents, waxes and lubricants. Suitable charge control agents are disclosed, for example, in U.S. Pat. Nos. 3,893,935 and 4,323,634 to Jadwin et al. and 4,079,014 to Burness et al.; and British Patent No. 1,420,839 to Eastman Kodak. Charge control agents are generally employed in small quantities such as from about 0 to 10 parts per hundred based upon the weight of the total solids content (weight of the toner) and preferably from about 0.2 to about 3.0 parts per hundred.

The resultant mixture is then subjected to mixing and homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume, may range from 1:1 to approximately 9:1. This indicates that the organic phase is typically present in an amount from about 10% to 50% of the total homogenized volume.

Following the homogenization treatment, the solvent present is evaporated and the resultant product washed and dried.

As indicated, the present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polytrifluoroolefins, such as polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methylacrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers and the like.

Pigments suitable for use in the practice of the present invention should be capable of being dispersed in the polymer, insoluble in water and yield strong permanent color. Typical of such pigments are the organic pigments such as phthalocyanines, lithols and the like and inorganic pigments such as TiO2, carbon black and the like. Typical of the phthalocyanine pigments are copper phthalocyanine, a mono-chlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118; azo pigments such as toluidine red C169 and hansa yellow; and metallized pigments such as azo yellow and permanent red. The carbon black may be any of the known types such as channel black, furnace black, acetylene black, thermal black, lamp black and aniline black. The pigments are employed in an amount sufficient to give a content thereof in the toner from about 1% to 40%, by weight, based upon the weight of the toner, and preferably within the range of 4% to 20%, by weight.

The SOLSPERSE® chosen for use in the practice of the present invention is manufactured by Zeneca and is readily available from commercial sources. Ethyl acetate has been found to be the preferred solvent for use in the SOLSPERSE® dissolution step.

The SOLSPERSE® found to be particularly useful for this purpose is SOLSPERSE® 24000 or 20000, used in an amount ranging from 0.1% to 10%, by weight, based upon the weight of the final toner.

The invention will be more fully understood by reference to the following exemplary embodiment which is set forth solely for purposes of exposition and is not to be construed as limiting.

EXAMPLES

Example 1

A melt dispersion was prepared by mixing on a two roll mill at 130° C. 60.0 g of commercially available polyester polymer (Kao Binder N sold by Kao Corporation in Tokyo Japan) and 40.0 g of Regal 330 (black) pigment. Thirty-eight grams of the melt dispersion were then added to 210.5 g of Kao Binder P and 970.0 g of ethyl acetate. To the above solution was added 2.5 g of SOLSPERSE® 24000. This mixture was comprised of 6.0% pigment, 1.0% SOLSPERSE® 24000 and 93.0% binder and comprised the organic phase in this evaporative limited coalescence process. The organic phase was then mixed with an aqueous phase comprising 1275.0 ml of pH 4 buffer containing 120.0 g of Nalco® 1060 and 24.0 ml of 10% poly(adipic acid-comethylaminoethanol). This mixture was then subjected to very high shear using a Polytron sold by Brinkman followed by a Microfluidizer sold by Microfluidics. Upon exiting, the solvent was removed from the particles so formed by stirring overnight at room temperature in an open container. These particles were washed with 0.1N potassium hydroxide solution to remove the silica followed by water wash and then dried. The toner particles were of the order of 5.8$\mu$ volume average and entirely nonspherical.

Example 2

A media milled dispersion of fanal pink was prepared from a mixture of 40.0 g of the fanal pink pigment, 60.0 g of commercially available polyester polymer (Kao Binder N) in 670.0 g of ethyl acetate (13.0% solids of mixture). To 336.5 g of the above media milled dispersion were then added 206.3 g Kao Binder P and 677.2 g of ethyl acetate. To the above solution was added 2.5 g of SOLSPERSE® 24000 dissolved in 30.0 g of hot ethyl acetate. This mixture was comprised of 7.0% pigment, 1.0% SOLSPERSE® 24000 and 92.0% binder and comprised the organic phase in the evaporative limited coalescence process. The organic phase was then mixed with an aqueous phase comprising 1275.0 ml of pH 4 buffer containing 120.0 g of Nalco® 1060 and 26.2 ml of 10% poly(adipic acid-comethylaminoethanol). This mixture was then subjected to very high shear using a Polytron sold by Brinkman followed by a Microfluidizer. Upon exiting, the solvent was removed from the particles so formed by stirring overnight at room temperature in an open container. These particles were washed with 0.1N potassium hydroxide solution to remove the silica followed by water and dried. The toner particles were of the order of 6.4$\mu$ volume average and entirely nonspherical.

Example 3

The procedure of example 2 was repeated with the exception that the magenta pigment was replaced by Bridged Aluminum Phthalocyanine/Copper Phthalocyanine pigments manufactured by Eastman Kodak and BASF respectively. The resultant particles were non-spherical and particle size was 5.7$\mu$.

Example 4

The procedure of example 2 was repeated with the exception that the magenta pigment was replaced by Pigment Yellow 180 manufactured by BASF. The resultant particles were non-spherical and particle size was 6.3$\mu$.

Comparative Example I

The procedure of example 1 was repeated with the exception that the SOLSPERSE® 24,000 was omitted from the mixture. The resultant particles were completely spherical and particle size was 6.7$\mu$.

Example 5

The procedure of example 2 was repeated with the exception that the pigment was omitted from the mixture. The mixture was comprised of 1.0% SOLSPERSE® 24000 and 99.0% binder. The resultant particles were non-spherical and particle size was 5.3$\mu$.

Example 6

The procedure of example 2 was repeated with the exception that the pigment was omitted from the mixture. The mixture was comprised of 0.25% SOLSPERSE® 24000 and 99.75% binder. The resultant particles were non-spherical and particle size was 5.7$\mu$.

Comparative Example II

A melt dispersion was prepared by mixing on a two-roll mill at 130° C. 60.0 g of commercially available polyester polymer (Kao Binder N) and 40.0 g of Regal 330 (black) pigment. To 38.0 g of the melt dispersion were then added to 197.5 g of Kao Binder P and 900.0 g of ethyl acetate. To the above solution was added 15.0 g of carnauba wax dissolved in 100.0 g of hot ethyl acetate. This mixture was comprised of 6.0% pigment, 6% carnauba was and 88% binder and comprised the organic phase in this evaporative limited coalescence process. The organic phase was then mixed with an aqueous phase comprising 1275.0 ml of pH4 buffer containing 120.0 g of Nalco® 1060 and 24.0 ml of 10% poly(adipic acid-comethylaminoethanol). This mixture was then subjected to very high shear using a Polytron sold by Brinkman followed by a Microfluidizer. Upon exiting, the solvent was removed from the particles so formed by stirring overnight at room temperature in an open container. These particles were washed with 0.1N potassium hydroxide solution to remove the silica, followed by water, and dried. The resultant particles were bumpy to spherical and particle size was 5.7$\mu$.

Comparative Example III

To a solution 247.5 g of Kao Binder P and 970.0 g of ethyl acetate was added 2.5 g of SOLSPERSE®27000 dissolved in 30.0 g of ethyl acetate. This mixture was comprised of 1.0% SOLSPERSE®27000 and 99.0% binder and comprised the organic phase in the evaporative limited coalescence process. The organic phase was then mixed with an aqueous phase comprising 1275.0 ml of pH4 buffer containing 120.0 g of Nalco® 1060 and 26.2 ml of 10% poly(adipic acid-comethylaminoethanol). This mixture was then subjected to very high shear using a Polytron sold by Brinkman followed by a Microfluidizer. Upon exiting, the solvent was removed from the particles so formed by stirring overnight at room temperature in an open container. These particles were washed with 0.1N potassium hydroxide solution to remove the silica followed by water and dried. The toner particles were of the order of 5.0$\mu$ volume average and entirely spherical.

Example 7

The procedure of comparative example III was repeated with the exception that the SOLSPERSE®27000 was replaced with SOLSPERSE®20000. The mixture was comprised of 1% SOLSPERSE®20000 and 99% Kao Binder P. The resultant particles were nonspherical and particle size was 7.0$\mu$.

TABLE 1

| Specific Surface Area ($m^2/g$) | |
|---|---|
| Example | BET Value ($m^2/g$) |
| Example 1 | 2.76 |
| Example 2 | 2.25 |
| Example 3 | 2.71 |
| Example 4 | 2.37 |
| Example 5 | 2.66 |
| Example 6 | 1.59 |
| Example 7 | 1.86 |
| Comparative I | 0.95 |
| Comparative II | 1.13 |
| Comparative III | 1.00 |

The BET results tabulated above support the present claim of controlling the toner morphology by the introduction of SOLSPERSE® 24000 or 20000. BET value of approximately 1.00 $m^2/g$ denotes sphericity in the toner as is illustrated in comparatives I, II and III. Examples 1 through 6, which have SOLSPERSE® 24000 and example 7 which has SOLSPERSE® 20000 incorporated all have $\geqq 1.59$ $m^2/g$ BET values. BET values were calculated according to P. Chenebault and A. Schurenkamper, *The Measurement of Small Surface Areas by the B.E.T. Adsorption Method,* The Journal of Physical Chemistry, Volume 69, Number 7, July 1965, pages 2300–2305.

The invention has been described in detail with particular reference to certain preferred embodiments thereof, but it will be understood that variations and modifications can be effected within the spirit and scope of the invention.

What is claimed is:

1. A method for the preparation of electrostatographic toner comprising the steps of:

a) dissolving in ethyl acetate a hyperdispersant selected from SOLSPERSE® 24000 and SOLSPERSE® 20000, thereby forming a solution;

b) mixing the solution with a polymer material to form an organic phase;

c) dispersing the organic phase in an aqueous phase comprising a particulate stabilizer and homogenizing the resultant dispersion;

d) evaporating the solvent; and e) washing and drying the resultant product.

2. The method of claim 1 wherein a charge control agent is added in step b).

3. The method of claim 1 wherein a pigment is added in step b).

4. The method of claim 1 wherein a promotor is added in step b).

5. The method of claim 1 wherein the solvent is selected from chloromethane, dichloromethane, ethyl acetate, n-propyl acetate, iso-propyl acetate, vinyl chloride, methyl ethyl ketone, trichloromethane, carbon tetrachloride, ethylene chloride, trichloroethane, toluene, xylene, cyclohexanone and 2-nitropropane.

6. The method of claim 1 wherein the solvent is ethyl acetate.

7. The method of claim 1 wherein the pigment to SOLSPERSE® ratio ranges from 1:0.5 to 1.0:0.06.

8. The method of claim 1 wherein the particulate stabilizer is selected from the group consisting of highly cross-linked latex polymeric material, and $SiO_2$.

9. The method of claim 1 wherein the amount of particulate stabilizer is between 1 to 15 parts based on 100 parts of total solids in the toner.

10. The method of claim 1 wherein the relationship between the aqueous phase and the organic phase, by volume, ranges from 1:1 to 9:1.

11. The method of claim 1 wherein the organic phase contains lubricants.

12. The method of claim 1 wherein the organic phase contains waxes.

13. The method of claim 1 wherein the polymer material is selected from, olefin homopolymers and copolymers, such as, polyethylene, polypropylene, polyisobutylene and polyisopentylene; polytrifluoroolefins, such as polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methylacrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers.

14. The method of claim 1 wherein the polymer is polyester.

15. The method of claim 1 wherein the polymer is butyl acrylate-styrene copolymer.

16. The method of claim 1 wherein the pigment employed comprises from 1.0 to 40.0%, by weight, based upon the weight of the total solids present in the toner.

17. The method of claim 1 wherein the pigment employed comprises from 4.0 to 20.0%, by weight, based upon the weight of total solids present in the toner.

18. The method of claim 1 wherein the pigment is selected from TiO2; carbon black such as channel black, furnace black, acetylene black, thermal black, lamp black and aniline black; phthalocyanine pigments such as copper phthalocyanine, mono-chlor copper phthalocyanine, and hexadecachlor copper phthalocyanine; organic pigments such as anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118; azo pigments such as toluidine red C169 and hansa yellow; and metallized pigments such as azo yellow and permanent red.

19. The method of claim 1 wherein the pigment is selected from bridged aluminum phthalocyanine and carbon black.

20. In a method for preparing electrostatographic toner by dispersing an organic phase in an aqueous phase to yield a layer of particulate stabilizer on the surface of a polymer, the improvement which comprises adding SOLSPERSE® in a solvent to a polymer material, a pigment and optionally a charge control agent to form an organic phase for dispersing in the aqueous phase.

21. The method of claim 20 wherein the solvent is ethyl acetate.

22. The method of claim 20 wherein the polymer is selected from butyl acrylate-styrene copolymer and polyester.

23. Electrostatographic toner prepared in accordance with the method of claim 20.

24. Electrostatographic toner in accordance with claims 20 or 21 comprising carbon black and being nonspherical in shape.

* * * * *